United States Patent [19]

Lohrberg

[11] 4,238,302

[45] Dec. 9, 1980

[54] ELECTROLYTIC PROCESS OF RECOVERING OXYACIDS OF CHLORINE OR SALTS THEREOF

[75] Inventor: Karl Lohrberg, Heusenstamm, Fed. Rep. of Germany

[73] Assignee: Metallgesellschaft Aktiengesellschaft, Frankfurt am Main, Fed. Rep. of Germany

[21] Appl. No.: 91,312

[22] Filed: Nov. 5, 1979

[30] Foreign Application Priority Data

Nov. 22, 1978 [DE] Fed. Rep. of Germany ..... 2850575

[51] Int. Cl.[3] ..... C25B 1/34

[52] U.S. Cl. ..... 204/95; 204/103

[58] Field of Search ..... 204/95, 103

[56] References Cited

U.S. PATENT DOCUMENTS

| | | | |
|---|---|---|---|
| 3,799,849 | 3/1974 | Cook, Jr. et al. | 204/95 |
| 3,974,051 | 8/1976 | Elliott et al. | 204/95 |
| 4,004,988 | 1/1977 | Mollard et al. | 204/95 |
| 4,085,014 | 4/1978 | Bennett et al. | 204/95 |
| 4,088,550 | 5/1978 | Malkin | 204/95 |

*Primary Examiner*—R. L. Andrews

*Attorney, Agent, or Firm*—Sprung, Felfe, Horn, Lynch & Kramer

[57] ABSTRACT

An improved process for recovering oxyacids of chlorine or salts of such acids by the electrolysis of sea water or of salt solutions contaminated by metal ions is disclosed wherein extensive build-up of contaminating calcium ions and/or magnesium ions as the corresponding hydroxide on the cathode is prevented by the addition of precipitating chemicals at a pH value above 9. In accordance with the invention, the precipitating chemicals are not added to the sea water or salt solution contaminated by metal ions until a layer has been built up on the cathode such that the current efficiency has increased to a value in excess of 90 percent.

3 Claims, 1 Drawing Figure

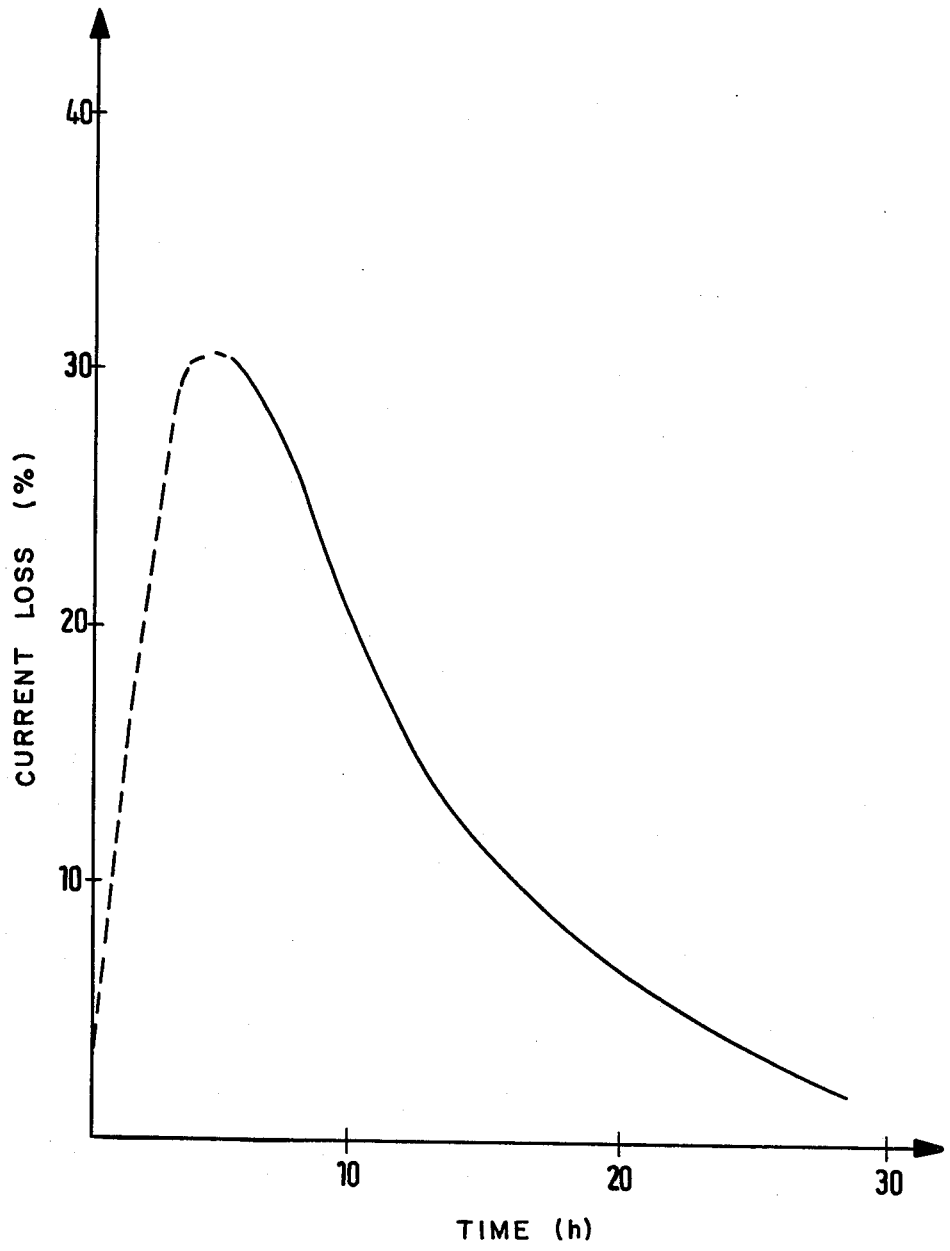
40
30
20
10
CURRENT LOSS (%)
10
20
30
TIME (h)

ELECTROLYTIC PROCESS OF RECOVERING OXYACIDS OF CHLORINE OR SALTS THEREOF

BACKGROUND

This invention relates to a process of recovering oxyacids of chlorine or salts of such acids by the electrolysis of sea water or of salt solutions contaminated by metal ions.

In the recovery of oxyacids of chlorine or of salts of such acids, such as sodium hypochlorite, by the electrolysis of sea water or of salt solutions contaminated by metal ions, difficulties are still encountered which adversely affect the commercial use and the economy of the process. The calcium or magnesium ions contained in such salt solutions react with the hydroxyl ions formed in the cathode space and such reactions result in a formation of calcium hydroxide and magnesium hydroxide and possibly also of carbonates.

Magnesium hydroxide tends to adhere to the cathode or to deposit on the walls of the electrolytic cell and in that case obstructs the flow of the electrolyte and reduces the efficiency. The growing deposits clog mainly the space between the anode and cathode in the electrolytic cell so that the latter cannot be operated continuously for a prolonged time.

In accordance with known proposals to avoid these difficulties, smooth, uninterrupted metal plates have been used as cathodes in the electrolytic production of hypochlorite and the velocity of flow has been increased and maintained at a certain relationship to the concentration of the electrolyte (German Offenlegungsschrift No. 2,619,497). Known electrolytic cells for the recovery of hypochlorite from sea water have been designed to provide for a directed electrolyte flow at a certain velocity (German Pat. No. 1,956,156).

In the production of alkali chlorates by the electrolysis of alkali chloride solutions, it is known to add alkali hydroxide or alkali carbonate to the electrolyte in order to decrease the current soluble hydroxides, such as calcium or magnesium hydroxide, to the electrolyte and to keep said hydroxide in suspension in the electrolyte throughout the electrolysis (German Pat. No. 90,060).

Finally, it is known to remove undesired metal ions from salt solutions intended for alkali chloride electrolysis and for this purpose to flocculate the ions of iron, magnesium and calcium in the form of carbonates and hydroxides (Swiss Pat. No. 505,751).

It is an object of the invention to decrease or control the formation of deposits on the cathode during the recovery of solutions of oxyacids of chlorine or salts of such acids by the electrolysis of sea water or of salt solutions contaminated by metal ions. In such process, the advantages of known processes should be utilized but their disadvantages should be avoided.

STATEMENT OF INVENTION

In accordance with the invention, oxyacids of chlorine or salts of such acids are recovered from sea water or salt solutions contaminated by metal ions by electrolysis in electrolytic cell. The feed to the electrolytic cell contains contaminating metal ions, particularly calcium ions and/or magnesium ions. In accordance with this invention, these calcium ions and magnesium ions are permitted to form calcium hydroxide and/or magnesium hydroxide on the cathode, the formation being controlled, however, such that the current efficiency increases to a value in excess of 90 percent. After the current efficiency of the electrolytic cell has increased to such a value, further deposition of calcium ions and/or magnesium ions on the cathode as the corresponding hydroxide is precluded by treatment of the sea water or salt solution to be subjected to hydrolysis with precipitating chemicals, i.e., chemicals which precipitate the calcium and/or magnesium ions. Precipitation of the calcium ions or magnesium ions can be done by pretreatment of the feed to the electrolysis cell.

Precipitation is preferably effected by adjusting the pH of the sea water or salt solution to a value above 9 by addition of sodium hydroxide solution and/or calcium hydroxide and sodium carbonate. The precipitate optionally can be removed from the vessel wherein precipitation is effected.

In a process of the stated kind in which oxyacids of chlorine or salts of such acids are recovered by the electrolysis of sea water or of salt solutions contaminated by metal ions, the invention resides in that the electrolytic cell is operated with non-purified sea water or non-purified salt solution until compounds of the contaminating metal ions, particularly calcium ions and/or magnesium ions, have formed on the electrodes a layer which has an adequate thickness so that a current efficiency in excess of 90% is obtained, whereafter the calcium ions and/or magnesium ions contained in the non-purified sea water or in the non-purified salt solution are precipitated entirely or in part at a pH value above 9 by an addition of sodium hydroxide solution and/or calcium hydroxide and sodium carbonate, the precipitate is optionally removed, and the purified solution is fed to the electrolytic cell.

For the purposes of the invention, the layer is regarded as having an adequate thickness when a current efficiency in excess of 90% is obtained.

Regardless of the concentration of the impurities in the salt solution, the latter is fed to the electrolytic cell in the process according to the invention until a layer having an adequate thickness has been formed. As the layer consisting particularly of hydroxides and carbonates of calcium and magnesium grows to that thickness, the current efficiency increases gradually to values in excess of 90%. That rise generally takes 5 to 30 hours, in which the cell voltage increases by 0.2 to 0.3 volts at a given current density, as a rule. After that deposition phase, the cell voltage continues to increase by 1 to 1.5 volts within 100 to 2000 hours depending on concentration. As soon as a current efficiency of 90% has been reached in the process according to the invention, the supply of non-purified salt solution is discontinued and purified salt solution is fed to the electrolyte. The impurities contained in the sea water or in the salt solution consist mainly of ions of calcium and/or magnesium or iron and are precipitated at a pH value above 9 by an addition of sodium hydroxide and/or calcium hydroxide and of sodium carbonate. Where calcium hydroxide and sodium carbonate are used, the magnesium ions are precipitated by the hydroxyl ions of the calcium hydroxide, and the calcium ions are precipitated by the carbonate ions. There is thus formed precipitated magnesium hydroxide and calcium carbonate. The impurities are completely precipitated, as a rule. In some cases it may be sufficient, depending on the conditions in the electrolytic cells, to precipitate a major part of the impurities.

It is generally suitable to remove the precipitated impurities, e.g., by filtration, possibly with an addition of filtering aids. In electrolytic cells which are relatively insensitive to finely divided solids, all or part of the precipitates may remain in the feed brine or salt solution in a state of fine division.

It is also known that impurities consisting of, e.g., calcium salts or magnesium salts comprising about 5 mg $Ca^{++}$/liter or 1 mg $Mg^{++}$/liter in the feed brine will be deposited on the cathodes and will gradually form a layer.

Conventional electrolytic cells are used in the process according to the invention, for instance, electrolytic cells in which vertical anodes and cathodes are arranged in alternation. The interelectrode distance amounts, e.g., to 2 to 5 mm, and at a velocity of flow of 0.3 to 2 m/s the electrolyte is electrolyzed at a current density of 2 to 25 A/dm$^2$. The temperature of the electrolyte may amount to 10° to 50° C. and its pH value may lie in the range of 7 to 10. The cathodes consist of electrically conducting, wear-resisting metallic materials, such as titanium or nickel or alloys of iron and nickel. Whereas the anodes may consist of graphite, particularly suitable anodes consist of electrodes of titanium, niobium or tantalum which noble metal or noble metal oxide, or of so-called dimensionally stable anodes, which have an electrocatalytic activity due to the presence of mixed oxides of noble metals and film-forming metals, particularly titanium.

In the electrolytic production of hypochlorite from sea water or salt solutions, the following chemical reactions take place on the electrodes. On the anode:

$$2Cl^- \rightarrow Cl_2 + 2e$$

On the cathode:

$$2Na^+ + 2e \rightarrow 2Na$$

$$2Na + 2H_2O \rightarrow NaOH + H_2$$

Chlorine reacts with the sodium hydroxide to form sodium hypochlorite in accordance with the formula:

$$Cl_2 + 2\ NaOH \rightarrow NaClO + NaCl + H_2O$$

Sodium hypochlorite reacts with water to form hypochlorous acid:

$$NaClO + H_2O \rightleftarrows HClO + Na^+ + OH^- \quad (1)$$

Hypochlorous acid dissociates in accordance with $$HClO \rightleftarrows ClO^- + H^+ \quad (2)$$

Whether reaction (1) or reaction (2) predominates will depend on the pH value of the medium. At a pH value above 5, all of the active chlorine will be present in the form of hypochlorous acid and hypochlorite ions and the content of the latter will increase with the increasing pH balue.

The advantages afforded by the process according to the invention reside in that there is a controlled formation of a layer on the cathodes in all electrolytic cells of the plant. The thin passive layer which is deposited in accordance with the invention prevents a strong reduction of the hypochlorite ions and will thus increase the yield of hypochlorite and will eliminate or very substantially decrease the need for cleaning the cells.

DESCRIPTION OF DRAWING

The invention will now be explained by way of example with reference to the accompanying drawing which is a diagram in which the efficiency of hypochlorite cells is plotted against operating time.

EXAMPLE

A plant comprising 8 cells electrically connected in series was supplied with sea water at 28° C. at a rate of 20 m$^3$/h. For 30 hours, the current was gradually increased from 500 to 5000 A. This was accompanied by a voltage rise from 25 to 35 V. During the same time, the content of active chlorine in the form of NaOCl increased from 0.2 g/l to 2.8 g/l. The current efficiency varied as shown in the diagram of the accompanying drawing. If no precipitating chemicals were added, the current efficiency would asymptotically approach 100%, the voltage would increase at the same time and the soiling would increase so that the plant would have to be shut down for being washed with acid after not more than 2000 hours. During normal operation, the voltage drop per cell amounts to about 4.5 V and the current efficiency to 96%. The voltage across soiled cells increases to as much as 6 V and the current efficiency may be almost 100%. The d.c. energy consumption amounts in the first case, during normal operation, to 3.6 kWh/kg $Cl_2$ and in the second case, in soiled cells, to 4.5 kWh/kg $Cl_2$. That increased energy consumption and the need for regular washing can be eliminated in that the impurities are precipitated if, in accordance with the invention, that precipitation is begun when a protective layer of adequate thickness has formed on the cathodes.

What is claimed is:

1. In a process for recovering oxyacids of chlorine or salts of such acids by the electrolysis of sea water or salt solutions contaminated by metal ions wherein extensive build-up of calcium hydroxide or magnesium hydroxide on the cathode is prevented by precipitating calcium ions and/or magnesium ions by adding precipitating chemicals to the sea water or the salt solutions contaminated by metal ions, the improvement wherein the electrolytic cell is operated such that there is formed on the cathode a layer of calcium hydroxide and/or magnesium hydroxide such that the current efficiency of the electrolytic cell increases to a value in excess of 90 percent and thereafter there is added to the sea water or salt solution contaminated by metal ions said precipitating chemicals and the purified solution is fed to the electrolytic cell.

2. A process according to claim 1 wherein the precipitating chemicals comprise sodium hydroxide solution and/or calcium hydroxide solution and sodium carbonate and the pH of the sea water or salt solution undergoing electrolysis is raised to a value above 9.

3. A process according to claim 2 wherein said precipitating chemicals comprise a mixture of calcium hydroxide and sodium carbonate.

* * * * *